United States Patent [19]

Gaskill

[11] 3,984,795

[45] Oct. 5, 1976

[54] MAGNETIC LATCH CONSTRUCTION

[75] Inventor: George Gaskill, Hatboro, Pa.

[73] Assignee: I-T-E Imperial Corporation, Spring House, Pa.

[22] Filed: Feb. 9, 1976

[21] Appl. No.: 656,108

[52] U.S. Cl. ..... 335/170; 335/174; 335/254

[51] Int. Cl.[2] ..... H01H 9/20

[58] Field of Search ..... 335/229, 230, 234, 253, 335/254, 170, 174, 175

[56] References Cited

UNITED STATES PATENTS

| | | | |
|---|---|---|---|
| 3,022,450 | 2/1962 | Chase | 335/253 X |
| 3,683,239 | 8/1972 | Sturman | 335/170 X |
| 3,783,423 | 1/1974 | Mater et al. | 335/229 X |
| 3,792,390 | 2/1974 | Boyd | 335/234 X |
| 3,886,507 | 5/1975 | Johnston et al. | 335/254 X |

*Primary Examiner*—George Harris
*Attorney, Agent, or Firm*—Ostrolenk, Faber, Gerb & Soffen

[57] ABSTRACT

An electrically releaseable permanent magnet latch includes a magnetic tube disposed within a U-shaped magnetic frame. Disposed within the tube are a lightweight armature and a coil spring biasing the armature forward. An electromagnet coil is wound about the tube and a pair of permanent magnets are inside the frame outboard of the tube. Magnetic diverter plates abut the magnets and are interposed between the magnets and coil. A collar on the tube provides a direct magnetic bridge to the diverters. Energization of the coil creates a flux which bucks the permanent magnet flux to permit the spring to overcome the armature holding force whereby the spring operates the armature.

10 Claims, 4 Drawing Figures

MAGNETIC LATCH CONSTRUCTION

This invention relates generally to compact magnetic latches and more particularly relates to latches of this type that are released by electromagnetic means.

In many electromagnetic devices permanent magnets are often used to hold working elements in normal or latched positions against forces generated by biasing springs so that no electrical energy is required to maintain the latched condition. Latch release is obtained by generating a flux field electromagnetically over a short time interval. This electrically generated flux field opposes the permanent magnet field to the extent that the force of the net field is less than the spring force so that the latter is effective to release the latch and cause operation of a utilization device, such as a trip mechanism of a circuit breaker as described in U.S. Pat. No. 3,783,423 issued Jan. 1, 1974 to A. E. Mater and A. Wafer for Circuit Breaker With Improved Flux Transfer Magnetic Actuator.

Copending application Ser. No. 656,107 filed Feb. 9, 1976 by Peter Pang for Magnetic Latch With Shunt Path Barrel and assigned to the assignee of the instant invention, discloses a compact magnetic latch requiring low actuating power. Such latch is constructed by mounting a lightweight movable armature within a magnetic tube or barrel. A biasing spring mounted within the tube urges the armature toward one end of the tube so that an armature extension will project from the tube and engage a utilization device. The tube extends through the coil of an electromagnet and magnets are positioned outside the tube at diametrically opposite points thereof. The tube, coil and magnets are disposed within a U-shaped magnetic frame with the tube axis extending parallel to the arms of the frames and positioned midway therebetween. Normally, the armature is held in a retracted position by the force of the magnetic flux field generated by the permanent magnets. Energization of the coil generates flux in opposition to the permanent magnet flux whereby the force of the net flux acting on the armature is insufficient to maintain the armature holding force above the spring force acting in opposition thereto. Thus, the spring is now effective to move the armature so that its extension projects beyond the barrel and actuates a utilization device.

In accordance with the instant invention magnetic directors or diverter plates are interposed between the magnets and coil and a magnetic collar on the tube provides a flux bridge between the forward ends of the diverters and the tube near its forward end. This permits increased coil length resulting in increased coil size while reducing power in that mean turn length is decreased. Magnet face area is increased although thickness is decreased resulting in greater total flux.

Accordingly, a primary object of the instant invention is to provide a novel construction for a permanent magnet latch.

Another object is to provide a latch of this type that is of compact construction in relation to the spring force that is active when the latch is released.

Still another object is to provide a latch of this type having a relatively low mass armature.

A further object is to provide a latch of this type in which the armature is protected against contamination by being disposed within a permeable tube.

A still further object is to provide a latch of this type which permits utilization of relatively large permanent magnets without saturating the armature, and permits utilization of a relatively large coil of reduced electrical resistance.

These objects as well as other objects of this invention shall become readily apparent after reading the following description of the accompanying drawings in which.

Figure 1:
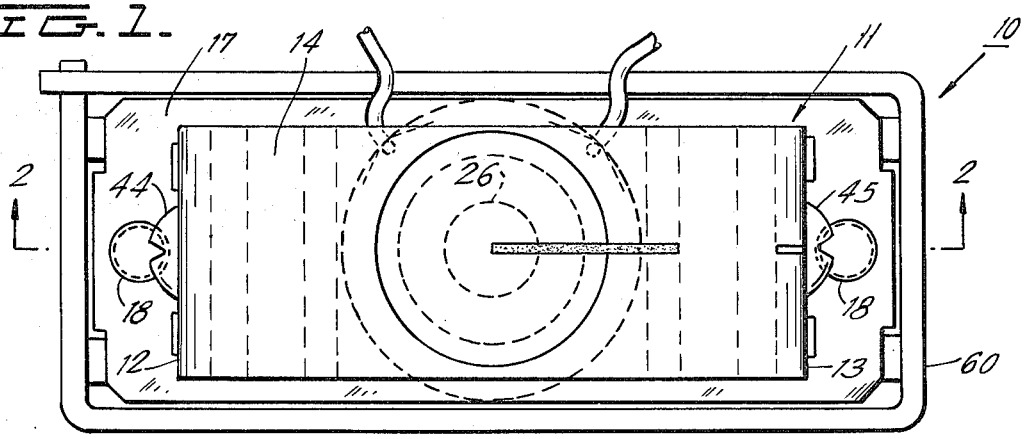
FIG. 1 is a rear elevation of a permanent magnet latch constructed in accordance with teachings of the instant invention.

Now referring to the figures. Permanent magnet latch 10 includes U-shaped magnetic frame 11 having arms 12,13 which extend rearwardly from opposite ends of web 14. The front ends of arms 12,13 are provided with forwardly extending tongues 15 that extend through apertures 16 of inner brass plate 17 and are staked to mechanically secure plate 17 to frame 11. A pair of studs 18 extend through clearance apertures 19 of outer brass plate 20 and are received by threaded apertures 21 of plate 17 to secure plate 17, 20 in abutting relationship.

Cylindrical barrel or tube 25 is disposed within frame 11 with the cylindrical axis of tube 25 extending parallel to arms 12,13 and midway therebetween. The forward end of tube 25 abuts deformable 24 and non-magnetic stepped ring spacer 23 is interposed between the rear of tube 25 and web 14. O-ring 24 and the front of tube 25 are positioned inside of central aperture 29 in plate 17. Disposed within tube 25 is lightweight magnetic armature 26 having non-magnetic extension 27 which projects through central aperture 28 of plate 20. Also disposed within tube 25 and surrounding the reduced diameter rear section 31 of armature 26 is coiled compression spring 32 whose rear end abuts spacer 23 and whose forward end abuts armature shoulder 33 so that spring 32 biases armature 26 forward.

Tube 25 extends through central aperture 36 of coil assembly bobbin 34. Coil 37 of assembly 35 is wound about bobbin 34 with the coil turns being generally concentric with tube 25. Bar magnets 42,43, disposed within frame 11, abut respective arms 12,13 and are positioned outboard of coil assembly 35. The poles of magnets 42,43, indicated N and S are positioned so that the magnetic axes are generally perpendicular to the cylindrical axis of barrel 25. Non-magnetic rivets 44,45 secure the respective magnets 42,43 to frame arms 12,13 and secure the respective magnetic director or diverter plates 46,47 to the respective magnets 42,43 in abutting relationship with the inner faces of these magnets. Thus, diverter 46 is interposed between magnet 42 and coil 37, and diverter 47 is interposed between magnet 43 and coil 37.

The ends of each of the diverters 46, 47 are offset in opposite directions with the offsets at the forward ends projecting inwardly and engaging the forward surface of magnetic collar or ring 51 that is closely fitted, though not forced, on the outer surface of tube 25. Spacer washer 52 and wavy spring washer 53 are interposed between collar 51 and the forward end of coil assembly 35. Generally rectangular magnetic wall 60 along the periphery of plate 17 is secured to plate 17 and extends rearwardly therefrom to provide a stray field shield for frame 11.

Figure 2:
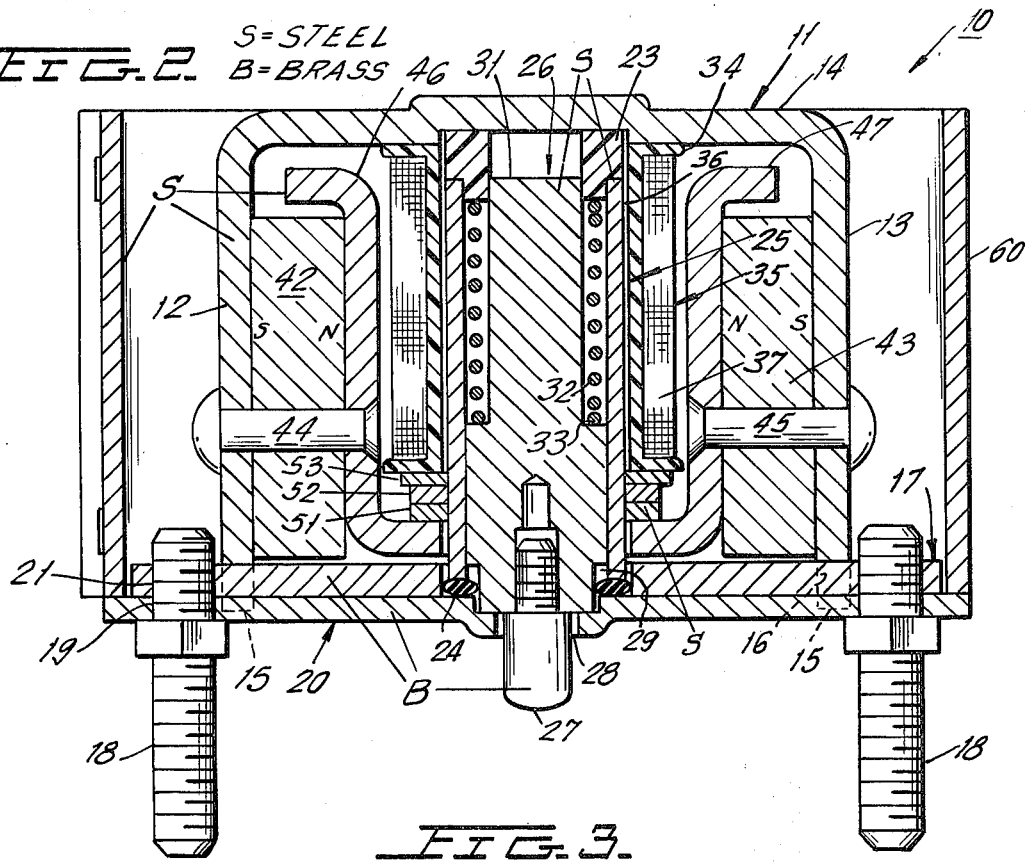
FIG. 2 is a cross section taken through line 2—2 of FIG. 1 looking in the direction of arrows 2—2.
Figure 3:
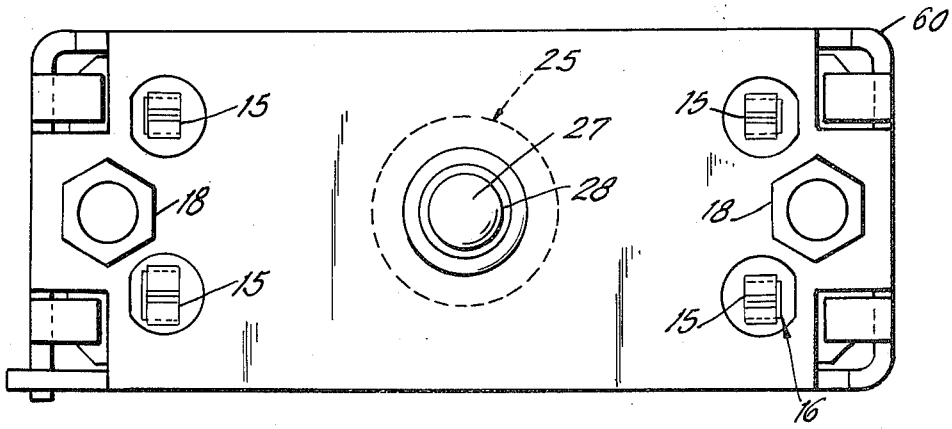
FIG. 3 is a front elevation of the latch of FIGS. 1 and 2.
Figure 4:
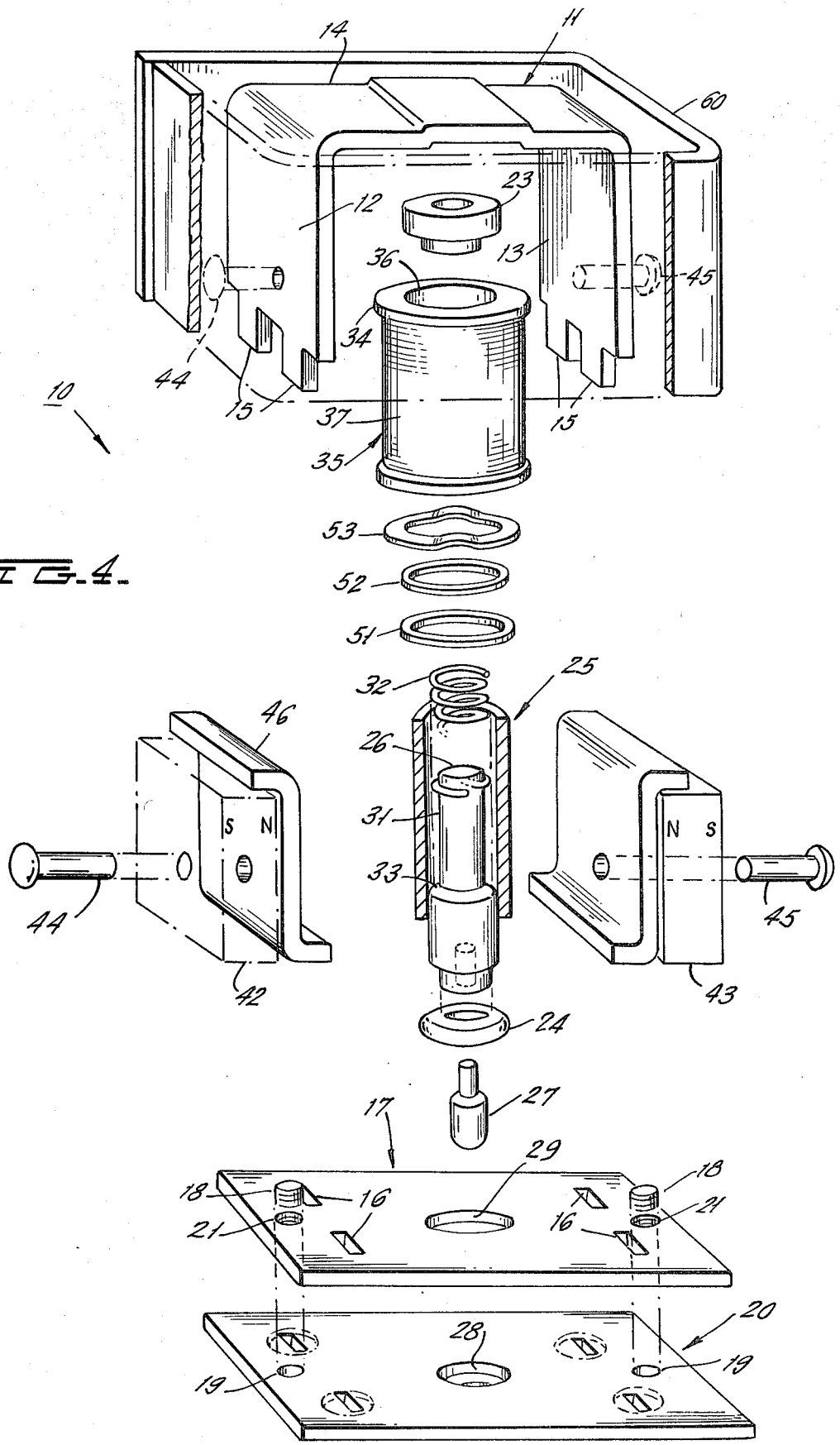
FIG. 4 is an exploded perspective of the latch of FIGS. 1 through 3.

In FIG. 2 permanent magnet latch 10 is shown in its unlatched or released position wherein armature 26 occupies its most forward position in abutment with plate 20. When armature 26 is moved rearward by a mechanical means (not shown) to a position wherein the rear of armature 26 engages web 14, the flux field provided by permanent magnet 42, 43 generate a sufficient mechanical force to hold armature 26 in this retracted position against the biasing force provided by spring 32. At this time elements 46, 47 can be said to direct flux toward armature 26. Subsequent energization of coil 37 generates a flux field which opposes the flux field of permanent magnet 42, 43 so that the force of the net flux field acting to hold armature 26 latched is less than the force provided by spring 32. Thus, spring 32 takes over and moves armature 26 rapidly to the unlatched position of FIG. 2.

Although the present invention has been described with respect to preferred embodiments, it should be understood that many variations and modifications will now be obvious to those skilled in the art and, therefore, the scope of this invention is to be limited, not by the specific disclosure herein, but only by the appended claims. In these claims the use of the term "magnetic" is meant to designate a material having high magnetic permeance, such as a ferro-magnetic material, and the term "non-magnetic" is meant to designate a material having low magnetic permeance, such as air or brass.

I claim:

1. A magnetic latch including a magnetic frame, a magnetic tube within said frame, a magnetic armature movable axially within said tube biasing means disposed within said tube and urging said armature in a first direction toward a first axial position near one end of said tube wherein an axial extension of said armature projects beyond said one end, permanent magnet means disposed within said frame and outside of said tube and generating a flux field that normally holds said armature against force generated by said biasing means in a second axial position wherein said extension is retracted, coil means disposed within said frame and having said tube extending therethrough, said coil means when energized generating magnetic flux opposing the flux field of said permanent magnet means to the extent that net flux is insufficient to hold the armature in said first axial position whereby the biasing means moves the armature to said first axial positions for actuation of an external device by said extension, and magnetic diverter means disposed within said frame and interposed between said coil and said permanent magnet means and said coil means.

2. A magnetic latch as set forth in claim 1 in which the frame is U-shaped having first and second spaced arms connected at one end by a web, said tube having its other end adjacent said web and its axis generally parallel to said arms.

3. A magnetic latch as set forth in claim 2 in which the permanent magnet means includes first and second sections, said first section being interposed between said first arm and said coil means, and said second section being interposed between said second arm and said coil means.

4. A magnetic latch as set forth in claim 3 in which the magnetic axes of said sections are generally perpendicular to the axis of the tube.

5. A magnetic latch as set forth in claim 3 in which the diverter means includes first and second elements disposed adjacent the respective first and second sections of the magnet means.

6. A magnetic latch as set forth in claim 5 in which the ends of the first and second elements closer to said one end of said tube are provided with offsets extending toward said tube.

7. A magnetic latch as set forth in claim 6 also including magnetic bridge means snugly fitted to the outside of said tube and abutting the offsets of both said first and second elements.

8. A magnetic latch as set forth in claim 6 in which the other ends of the first and second elements are provided with other offsets extending away from said tube.

9. A magnetic latch as set forth in claim 8 also including magnetic bridge means snugly fitted to the outside of said tube and abutting the offsets of both said first and second elements.

10. A magnetic latch as set forth in claim 5 in which each of the first and second sections of said magnet means is a bar having a length substantially greater than half the length of the tube, and the length of the coil is substantially greater than half the length of said tube.

* * * * *